US009382667B2

(12) United States Patent
Young et al.

(10) Patent No.: US 9,382,667 B2
(45) Date of Patent: Jul. 5, 2016

(54) RAIL CLIP

(71) Applicant: Progress Rail Services Corporation, Albertville, AL (US)

(72) Inventors: Hartley Frank Young, Melton (AU); Jose Ricardo Mediavilla, Kansas City, MO (US)

(73) Assignee: Progress Rail Services Corporation, Albertville, AL (US)

( * ) Notice: Subject to any disclaimer, the term of this patent is extended or adjusted under 35 U.S.C. 154(b) by 0 days.

(21) Appl. No.: 14/396,351

(22) PCT Filed: Apr. 22, 2013

(86) PCT No.: PCT/IB2013/000841

§ 371 (c)(1),
(2) Date: Oct. 22, 2014

(87) PCT Pub. No.: WO2013/160760

PCT Pub. Date: Oct. 31, 2013

(65) Prior Publication Data

US 2015/0083816 A1 Mar. 26, 2015

(30) Foreign Application Priority Data

Apr. 23, 2012 (AU) ..... 2012901583

(51) Int. Cl.
*E01B 9/00* (2006.01)
*E01B 9/02* (2006.01)
*E01B 9/30* (2006.01)

(52) U.S. Cl.
CPC .. *E01B 9/02* (2013.01); *E01B 9/303* (2013.01)

(58) Field of Classification Search
CPC ..... E01B 9/02; E01B 9/04; E01B 9/30; E01B 9/303; E01B 9/306
See application file for complete search history.

(56) References Cited

U.S. PATENT DOCUMENTS 4,025,044 A * 5/1977 Goderbauer ..... E01B 9/303 238/349
4,313,563 A * 2/1982 Young ..... E01B 9/30 238/349
4,379,521 A * 4/1983 Young ..... E02D 29/0283 238/310

(Continued)

OTHER PUBLICATIONS

International Search Report PCT/IB2013/000841 dated Sep. 24, 2013.

*Primary Examiner* — Jason C Smith

(57) ABSTRACT

A rail clip for fastening railway rails to rail ties. The clip consists of U-shaped member formed from metal plate having a base with a free end and the other end curving upwards with an internal radius of 18 mm or less and a short straight section followed by a second curve and two tapered arms extending therefrom or beyond the curve, said base adapted to be secured to said tie outwardly spaced from the foot of said rail, said arms being bent downwards in a third curve beyond said base and finally the tip portion of said arms being bent backwards in a forth curve toward and short of said base to form toes which are orientated for contact with the top surface of the rail base such that said arms and toes are deflected upwards relative to said rail to develop downward clamping forces at the said toes which hold the said rail on the said tie to restrain longitudinal, lateral and vertical movement; after the said clip is formed it is hardened and tempered and then cold set by loading it in the same manner as occurs in track but the applied load is increased until the yield is passed and the clip is permanently deformed, the load is then removed & the process is repeated at least once.

6 Claims, 4 Drawing Sheets

(56) References Cited

U.S. PATENT DOCUMENTS 4,399,941 A * 8/1983 Lubbers ..... E01B 9/303 238/315
4,463,898 A * 8/1984 Young ..... E01B 9/30 238/310
4,685,618 A * 8/1987 Young ..... E01B 9/48 238/310
4,928,878 A * 5/1990 Young ..... E01B 9/48 238/351
5,110,046 A * 5/1992 Young ..... E01B 9/68 238/283
5,238,511 A * 8/1993 Gosling ..... B23P 15/00 148/624
5,605,284 A * 2/1997 Young ..... E01B 9/30 238/349
7,669,779 B2 * 3/2010 Young ..... E01B 9/303 238/310
2007/0063064 A1 * 3/2007 Young ..... E01B 9/306 238/264
2007/0138311 A1 * 6/2007 Young ..... E01B 9/303 238/107
2008/0203181 A1 * 8/2008 Young ..... E01B 9/303 238/351
2012/0031992 A1 * 2/2012 Mediavilla ..... E01B 9/30 238/351
2013/0306747 A1 * 11/2013 Cox ..... E01B 9/306 238/351
2015/0083816 A1 * 3/2015 Young ..... E01B 9/02 238/351
2015/0176223 A1 * 6/2015 Gardner ..... E01B 9/685 238/351

* cited by examiner

RAIL CLIP

PRIORITY

Priority is claimed as a national stage application, under 35 U.S.C. §371, to international application No. PCT/IB2013/000841, filed Apr. 22, 2013, which claims priority to Australian application No. AU2012901583, filed Apr. 23, 2012. The disclosures of the aforementioned priority applications are incorporated herein by reference in their entirety.

BACKGROUND TO THE INVENTION

The main function of modern rail clips is to hold the rail down so firmly that the rail will not become longer when the sun heats the rail & then not become shorter when the rail is subject to colder & freezing conditions. In other words the rail must compress or stretch but not move in the tie rail seats.

Long lengths of welded rail are commonly used so the longitudinal forces in the rail due to temperature change are very high. This means that the rail clips must clamp the rail very tightly.

A popular rail clip is described in U.S. Pat. No. 431,563 (Young).

Sometimes the clips become damaged & lose some of their clamping force which allows the rail to "run" in the tie rail seats. This can then cause serious problems to occur in the track which in the worst case can end in a derailment & train smash.

The main cause of clip damage is the clip fitting machines being out of adjustment and overdriving the clips during track maintenance.

This often happens in tight track curves where the high lateral forces on the rail cause the pads & insulators to wear so the clips have to be frequently removed for renewing these parts. This frequent removal & refitting of the clips increases the chance of an out of adjustment fitting machine damaging the clips.

In some cases the clips are routinely replaced in locations where they must be frequently removed. This is a considerable expense which should not be necessary since with many clip designs the clips have an indefinitely long fatigue life and do not "wear out". The replacement need is solely caused by clip fitting machine damage.

It is an object of this invention to provide a rail clip having a much reduced likelihood of losing a significant part of the toe load & thereby increasing the track safety & eliminating the need to replace damaged clips.

BRIEF DESCRIPTION OF THE INVENTION

The present invention provides a rail clip of the Young type which has been modified by a having a smaller radius of curvature at the base of the clip and cold setting the heat treated clip to improve its resistance to damage during fitting. In particular the invention provides a rail clip having a U shaped member formed from metal plate having a base with a free end and the other end curving upwards with an internal radius of up to 18 mm in a first curved section followed a short straight section followed by a second curve section consisting of two tapered arms extending from said first curved section or said straight section, said base adapted to be secured to said tie outwardly spaced from the foot of said rail, said arms being bent downwards in a third curved section beyond said base and finally the tip portion of said arms being bent backwards in a fourth curved section toward and short of said base to form toes which are orientated for contact with the top surface of a rail base and said clip having been cold set after being heat treated to improve its resistance to damage during fitting.

This invention is predicated on research that shows the damage from the fitting machines is caused by 2 main factors.

1. The fitting force applied to the clip after the clip has moved to its final position is too high & the clip then takes a permanent set & the toe load is reduced.
2. The shape of the clip back causes the force to be applied high on the clip back which in turn induces extra bending moments on the clip which when combined with (1) above increases the risk of damage There are many types of machines available for fitting the Young type clips and most of them have paddle type blades which act on the back of the clip which push the clips into position.

Usually there is a tendency for the back of the clip to lift up during fitting so the paddles are often inclined forwards at the top to hold the clip down.

A modern rail clip needs to have a rail seat toe load of at least 4800 Lbs to prevent movement due to temperature changes as previously explained but in addition each clip needs to have an installed deflection of at least 12 mm.

The actual clip deflection is governed by the tolerances on the clip & all mating parts & if the installed deflection is less than about 12 mm then there is likely to be a large variation in the toe load due to these tolerances & either the toe load may fall below safe limits if the deflection is too low or if it is too high the clip stress may exceed safe limits.

Since rail clips are used by the million, the design is critical from a cost point of view. The design needs to achieve maximum toe load plus maximum deflection using the minimum amount of steel This means cutting the safety margins down to the minimum & using an efficient design.

Tests by the inventor on the prior art clip have shown that a force of 4950 Lbs needs to applied to the back of the clip to ensure that it will always go on when the rail seat has all new components. Clips were fitted & refitted 10 times & the rail seat toe load stabilised at about 5070 lbs which is satisfactory.

Another test was done on the prior art clip with the fitting force maximum increased by 7.5% to 5319 Lbs After fitting & removing the clips 10 times the rail seat toe load stabilised at 4454 Lbs which is too low.

In practice the track men adjust the fitting force to ensure that the clips always go on but sometimes the tie is not fully up against the rail & when the clip goes on it must also lift the tie which takes extra force so the force will be increased to achieve this. However once the tie has lifted the force may be too much. The clips will all go on OK but they may be damaged which is not detectable by eye.

The next time the machine is used it may be with a different operator & if the clips go on OK the chances are that he will not reset the machine. He has no way of knowing that the clips are being damaged.

There are different types of insulators and some have nylon tops & others have metal tops. The metal topped insulators require a much higher clip fitting force because of the higher friction so if a machine is set to work with metal topped insulators & then later used on nylon insulators then probably the clips will be damaged.

In wet conditions the clips go on much easier so the risk of overdriving & clip damage is greater.

These problems have been known for 20 years & much has been done to overcome the difficulty but in spite of this the problem is still present.

In spring design it is well known that sharp bends & curves create stress concentrations which can cause failure so where they are present the working stress must be reduced and more steel is needed.

When this principle is applied to the prior art Young type of clip the radius at the back of the clip is usually made as large as possible so the maximum stress can be used. This is helpful in achieving maximum toe load & deflection for a given weight of steel. The prior art Young clip uses a radius of about 22 mm.

Preferably after the clip is formed, it is hardened and tempered and then cold set by loading it until the yield point is passed and the clip is permanently deformed by a large amount, the load is then removed & the process is repeated at least once. With this invention the tendency for the back of the clip to lift up during fitting is reduced. This invention greatly reduces this problem by using a small radius at the back of the clip.

Preferably the flat part of the clip extending from the end of the base curve makes an angle of 60° or less with the base.

Preferably the internal upward radius of the base is less than 15 mm.

A large installed deflection is able to reduce the variation in the toe load and in practice a deflection of about 17 mm gives a good compromise between toe load variation & clip cost.

In another aspect this new invention teaches how to make a clip which can survive a huge fitting force overload without reducing clip toe load. This is achieved by subjecting the clip to a cold set loading after heat treatment. Preferably in the cold setting process the first load application produces a permanent set of approximately 1.3 to 2, preferably 1.5 to 2 times the normal installed elastic deflection measured at the toes.

DETAILED DESCRIPTION OF THE INVENTION

Preferred embodiments of the invention will now be described with reference to the drawings in which FIG. 1 is a cross sectional view of a prior art rail seat using a prior art Young clip showing the clip in a preload and a load position Z;

Figure 1:
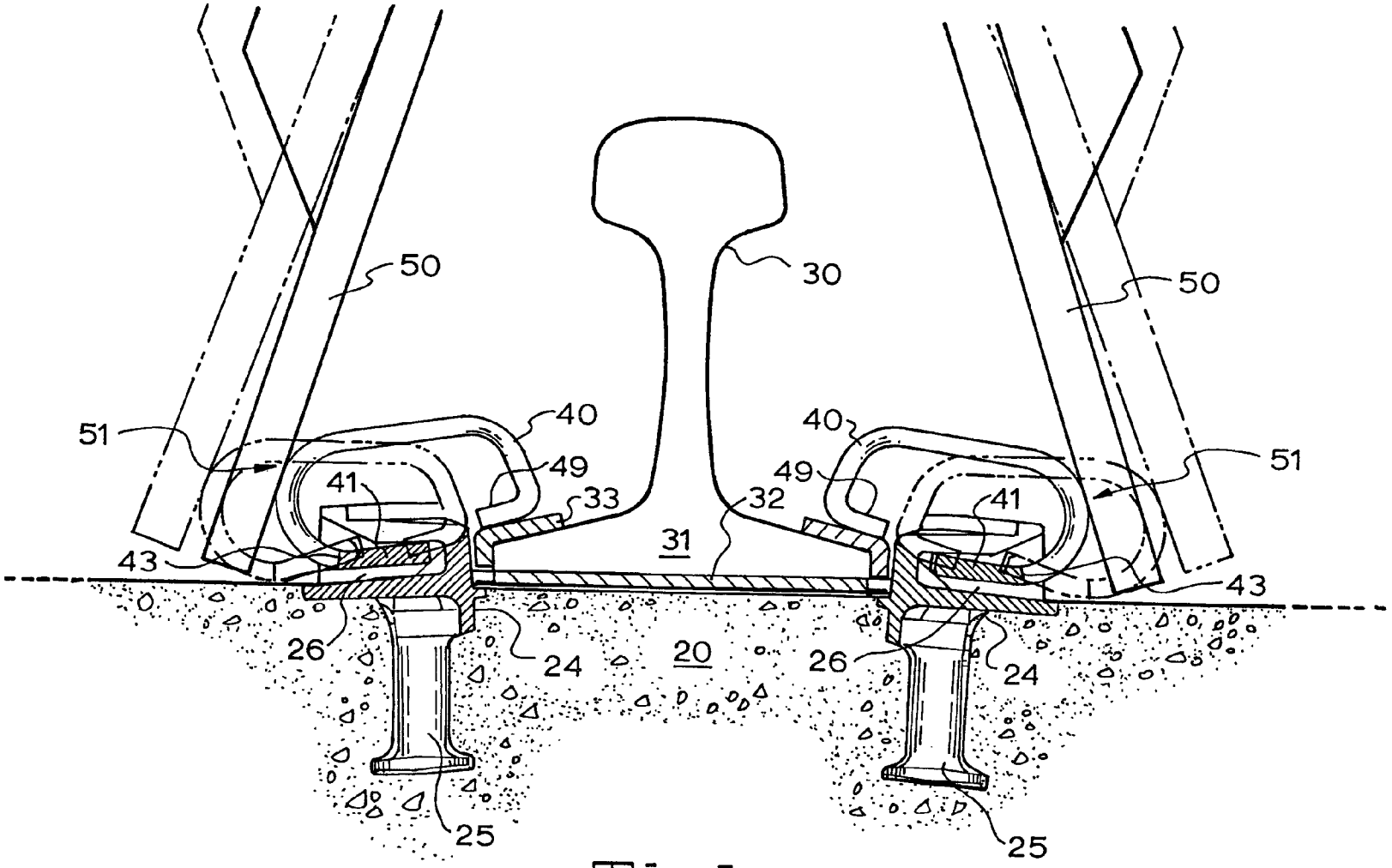
Fig. 1 PRIOR ART

FIG. 1 illustrates the prior art Young clip. The components of a typical rail seat are the concrete rail tie 20, the rail 30 with the rail base 31 seating on the rail pad 32 lying between the rail base 31 and the rail tie 20. On either side of the rail 30 are the clip support shoulders 24 with the shoulder legs 25 embedded in the concrete tie 20 and the clip recesses 26 on the surface of the tie. The rail clip 40 has a base 41 from which two tapered legs 42 project. The legs 42 are each curved into an inverted D shape with the toes 49 adjacent the base 41. The toes 49 are insulated from the rail base 31 by insulator 33. The prior art young clip uses a radius of about 22 mm for the curve from the base of the clip 41 and has the crotch 43, where the legs 42 of the clip commence, at the beginning of the curve. There are many types of machines available for fitting the Young type clips and most of them have paddle type blades 50 which act on the back of the clip as shown by arrow 51 in FIG. 1 to push the clips 40 into position.

Figure 2:
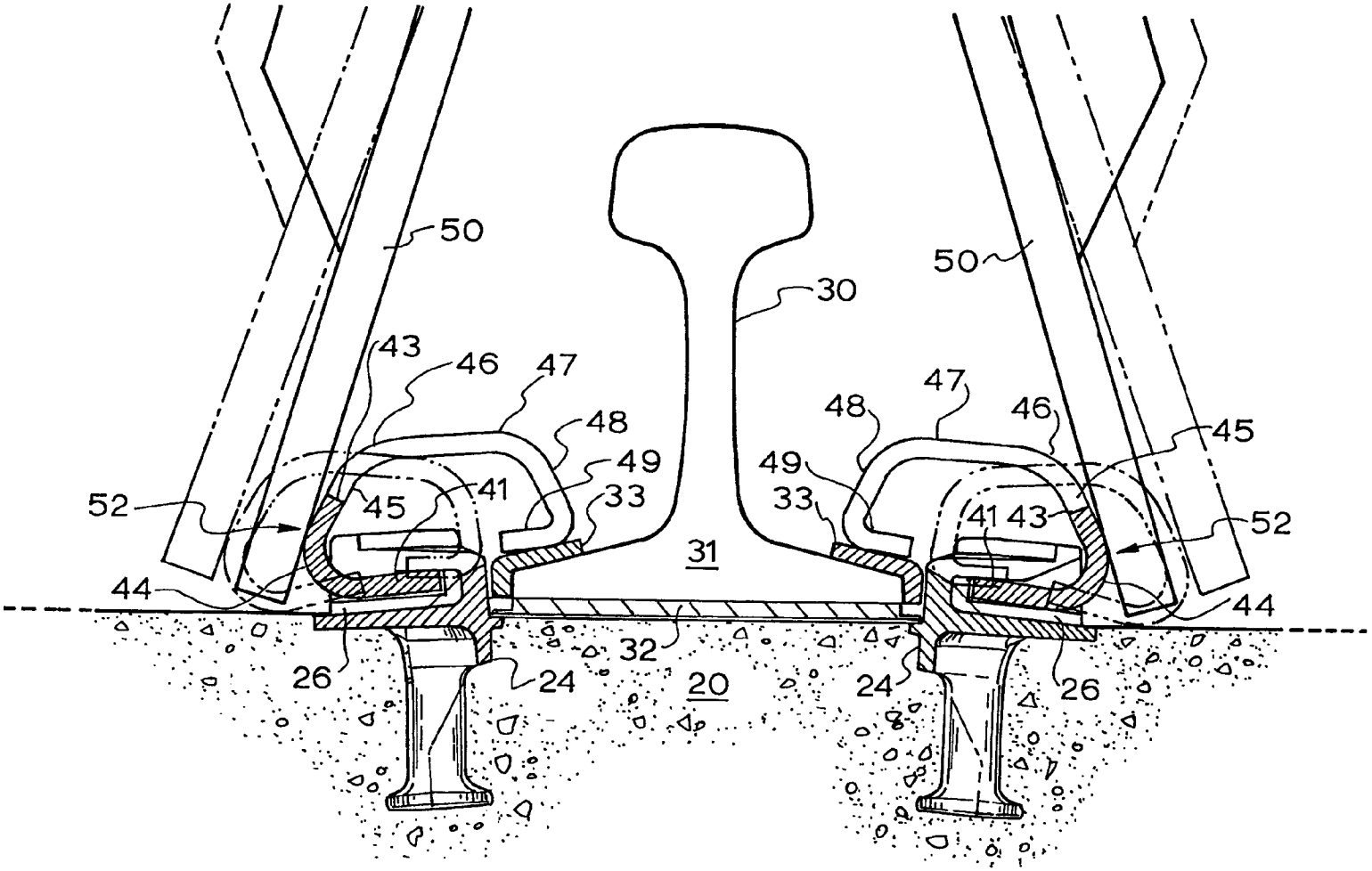
FIG. 2 is a cross sectional view of a rail seat using a rail clip according to the present invention showing the clip in a preload and a load position.
Figure 3:
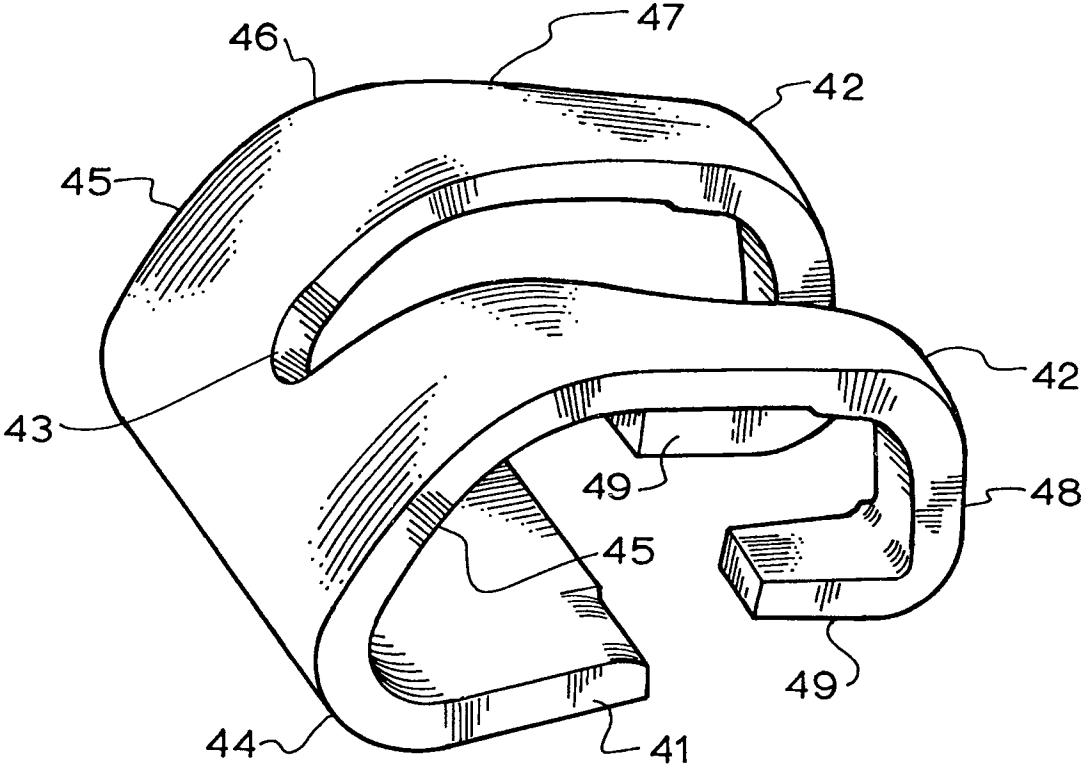
FIG. 3 is a perspective view of a rail clip according to the present invention.

The clip of the present invention is depicted in FIGS. 2 and 3 and has a shorter base section 41 followed by a first curved section 44 then a short straight section 45 containing the crotch 43 from which the legs 42 extend. The legs then each have a curved section 46 followed by a longer straight section 47 and the legs 42 each curve into the vertical section 48 and then into the inward extending toe sections 49.

The small base radius of section 44 as depicted in FIG. 2 also increases the load carrying capacity of this invention by reducing the overall length of the clip as follows:

The flat clip base 41 is held in in the recess 25 of the shoulder 24 cast into the tie and the toes 49 at the front of the clip press down on the rail base 31 to clamp it into place. It is an advantage for the toes 49 to overlap the rail base 31 a considerable distance so that in case of an extreme event, the rail can be tilted a long way before the clip toes come off the rail base 31 & the rail 30 rolls over.

However the maximum clip stress is proportional to the overall length of the clip so if the length is increased the maximum toe load must be reduced to hold the stress within safe limits.

For a given rail overlap this invention has a lower overall length & thus a higher potential toe load.

With a large first curve as per the prior art clip, the back of the clip is further behind the flat base so the overall length and bending moment arm are greater.

This invention uses a small first curve 44 so the distance from the back of the flat part of the base to the rear of the clip is less, thus the overall length is less and the toe load can be higher. (Compare FIGS. 1 & 2). This can be clearly seen by the distance from the back of the shoulder to the back of the clip being less in FIG. 2 compared to FIG. 1. The shorter overall length is not so apparent in FIG. 2 since this clip has a slightly greater reach than the prior art clip in FIG. 1.

This invention greatly reduces the problem of damage during fitting by using a small radius 44 at the back of the clip so that the fitting force line as indicated by arrows 52 on FIG. 2 is much lower down than as shown for arrow 51 in the prior art in FIG. 1.

After the base radius 44 the back of the clip extends upwards a short distance in section 45 before bend 46 commences and this straight section 45 needs to be at an angle of less than 60° relative to the base 41 so that the clip fitting paddle 50 cannot act on the clip above the base radius 44. This can be seen in FIG. 2.

However the small back radius 44, preferably of about 12 mm, would cause a stress concentration & require a reduced working stress thus downgrading the efficiency of the whole design.

This disadvantage is eliminated by cold setting a rail clip after heat treatment, so the clip deforms plastically beyond the yield sufficiently, to remove the stress concentrations. This is preferably done at least twice. This action removes the stress concentrations and also increases the permissible loading in some regions where there are no stress concentrations.

The inventor has discovered that the increase in the permissible loading is because when the bar is bent during cold setting the outer surface region of the bar yields, but the inner region is still within the elastic range.

This applies to both the outer tensile surface and the outer compression surface on the other side of the bar from which the clip is formed. From a fatigue life point of view, the tensile side is more important since this is where any failures are likely to commence. For the sake of simplicity only the tensile side is discussed, but the same is true on the opposite side but in reverse.

When the cold setting force is removed the bar then assumes its new bent shape which is the initial clip shape. The inner unyielded tension region tries to elastically return to its original shape but the outer tension region has taken a permanent set & is now longer, so it resists returning to the original shape. This produces a permanent compression preload to the outer previously tension surface.

This phenomenon increases the load carrying capacity by the compression prestress which exists on the tensile side. As the load is applied the compressive prestress must be overcome before the side can go into tension. The increase in load capacity is approximately equal to the force needed to remove the prestress. An extra benefit of this cold setting process is that any regions of stress concentration will yield more than the surrounding regions & effectively remove the stress concentrations provided the permanent set is large enough.

The method provided by this invention removes the stress concentrations which would otherwise result from using a small back radius by cold setting the clip after heat treatment.

In a preferred embodiment the clip is cold set by loading well beyond the yield at least twice. Not only does this remove the stress concentration but permits a higher than otherwise possible working stress in some other regions where there is little or no stress concentration.

Figure 4:
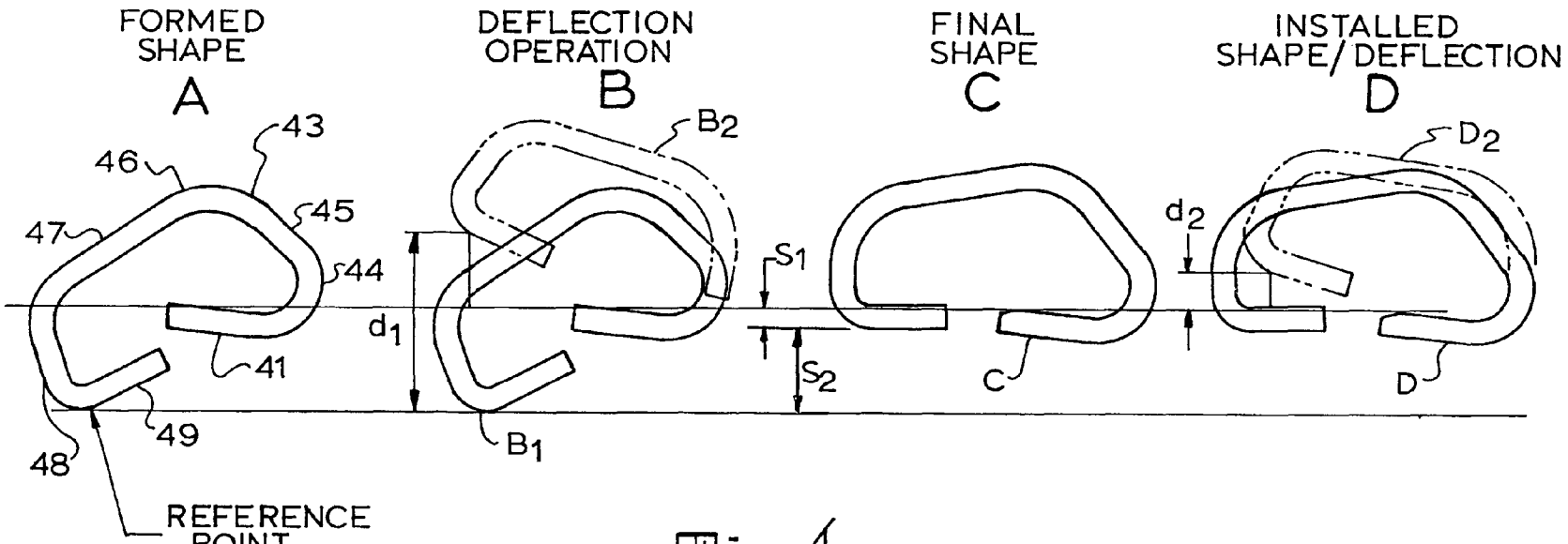
FIG. 4 illustrates the deflection of the clip during manufacture and use.

In FIG. 4A an as formed & heat treated clip is shown. In FIG. 4B a cold setting force F1 is applied to produce a cold setting deflection of d1 which takes the clip a long way past the start of yielding and plastic flow. When the force is removed the clip takes up a free position as shown in FIG. 4C with the toes at S1 relative to the reference line. S1 needs to be controlled within narrow limits so that when the clip is installed in track as shown in FIG. 4 D2 the toe load force F4 & installed deflection d2 are within specifications.

Cold setting deflection d1 & force F1 are adjusted to obtain the required S1 dimension.

When S1 is achieved the cold permanent set is S2 which must be large enough to remove the stress concentrations as previously explained. This will be achieved when S2 divided by d2 lies between 1.3 & 2.0

Another feature of this invention is that the crotch where the 2 legs join has been moved from the beginning of the base curve to the end or beyond the base curve. See FIGS. 2 & 3.

The rail seat toe load of the new invention can be as high as 5800 lbs with a deflection of 19 mm.

The force to fit the clip on metal topped insulators is about 6632 Lbs and a 100% overload force of 13,364 Lbs was applied without damaging the clip or reducing the toe load.

The prior art clips were seriously damaged with a 7.5% fitting overload force while the new invention was undamaged with a 100% overload fitting force. It is not known how much higher the fitting force would have to be, before damage occurred. This is a significant increase in the safety margin.

Thus those skilled in the art can see that this invention provides a unique an advantageous improvement in rail clip design. Those skilled in the art will also realise that this invention may be implemented in embodiments other than those shown without departing from the core teachings of the invention.

The invention claimed is:

1. A rail clip configured to hold down a rail to a rail tie, the rail clip comprising a base section formed from a metal plate, the base section having a first end which is free and a second end followed by a first curved section which curves upwards from the base section and has an internal radius of curvature of up to 18 mm, the first curved section followed by a short straight section, which is followed by a second curved section, the second curved section consisting of two tapered arms extending from one of the first curved section or the short straight section, the base section configured to be secured to a rail toe outwardly spaced from a foot of the rail, each tapered arm extending beyond the first end of the base section and being bent downwards in a third curved section, then bent back toward and short of the base section in a fourth curved section to form a toe, the toe of each tapered arm oriented for contact with a top surface of a rail base of the rail, wherein the rail clip is subjected to a cold setting process after being heat treated, thereby improving resistance to damage during fitting.

2. The rail clip as claimed in claim 1 wherein the internal radius of the first curved section is less than 15 mm.

3. The rail clip as claimed in claim 2 wherein the short straight section extending from the first curved section makes an angle of 60° or less with the base section.

4. The rail clip as claimed in claim 1 wherein after the said clip is formed, it is hardened and tempered and then cold set to remove stress concentrations, by placing the clip under a load until a yield point is passed and the clip is permanently deformed by a large amount, the load is then removed & the process is repeated at least once.

5. The rail clip as claimed in claim 4 wherein as part of the cold setting process a first load application produces a permanent set of approximately 1.3 to 2 times a normal installed elastic deflection measured at the toes.

6. The rail clip as claimed in claim 5 wherein the normal installed elastic deflection is about 17 mm.

* * * * *